US008165510B2

(12) United States Patent
Kadota et al.

(10) Patent No.: US 8,165,510 B2
(45) Date of Patent: Apr. 24, 2012

(54) DEVELOPMENT DEVICE AND IMAGE FORMING APPARATUS HAVING ELECTRODES THAT CAUSE TONER PARTICLES TO FORM A TONER CLOUD ON THE SURFACE OF THE TONER CARRIER

(75) Inventors: Ichiro Kadota, Kawasaki (JP); Yasuyuki Ishii, Machida (JP); Tomoko Takahashi, Yokohama (JP); Masaaki Yamada, Tokyo (JP); Hideki Kosugi, Yokohama (JP); Yoshinori Nakagawa, Yokohama (JP); Masanori Horike, Yokohama (JP); Nobuaki Kondoh, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 981 days.

(21) Appl. No.: 12/121,122

(22) Filed: May 15, 2008

(65) Prior Publication Data

US 2008/0286015 A1 Nov. 20, 2008

(30) Foreign Application Priority Data

May 16, 2007 (JP) ..... 2007-130588

(51) Int. Cl.
*G03G 15/08* (2006.01)

(52) U.S. Cl. ..... 399/266; 399/283

(58) Field of Classification Search ..... 399/266, 399/283

See application file for complete search history.

(56) References Cited

U.S. PATENT DOCUMENTS

| | | | |
|---|---|---|---|
| 6,658,227 | B2 | 12/2003 | Oyama et al. |
| 6,901,231 | B1 | 5/2005 | Sakai et al. |
| 7,024,142 | B2 | 4/2006 | Sakai et al. |
| 7,123,864 | B2 | 10/2006 | Miyaguchi et al. |
| 7,187,892 | B2 | 3/2007 | Horike et al. |
| 7,200,352 | B2 | 4/2007 | Sakai et al. |
| 7,236,720 | B2 | 6/2007 | Nakazato et al. |
| 7,308,222 | B2 | 12/2007 | Nakagawa et al. |
| 7,340,204 | B2 | 3/2008 | Nakazato et al. |
| 2006/0216071 | A1 | 9/2006 | Yamada et al. |
| 2006/0251449 | A1 | 11/2006 | Takahashi et al. |
| 2007/0013924 | A1 | 1/2007 | Sakai et al. |
| 2007/0015071 | A1 | 1/2007 | Tsukamoto et al. |
| 2007/0086811 | A1 | 4/2007 | Tsukamoto et al. |
| 2007/0212121 | A1 | 9/2007 | Takahashi et al. |
| 2007/0242985 | A1 | 10/2007 | Aoki et al. |

FOREIGN PATENT DOCUMENTS

| | | |
|---|---|---|
| JP | 3-21967 | 1/1991 |
| JP | 3-100575 | 4/1991 |
| JP | 3-113474 | 5/1991 |
| JP | 9-269661 | 10/1997 |
| JP | 2002-341656 | 11/2002 |
| JP | 2003-15419 | 1/2003 |
| JP | 2003-84560 | 3/2003 |
| JP | 2004-286837 | 10/2004 |

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

The development device includes a toner carrier, a toner supplier, and a surface electrical potential controller. When the toner supplier supplies toner particles to the toner carrier, the toner carrier carries toner particles to adhere to a latent image formed on the latent image carrier and has a time constant $\tau 1$ of a surface electrical potential change of the toner carrier. The surface electrical potential controller has a time constant $\tau 2$ of a surface electrical potential change of the toner carrier smaller than the time constant $\tau 1$. The toner carrier includes a plurality of electrodes aligned in parallel and electrically insulated from each other on the surface thereof, and a voltage supplier for supplying each of the plurality of electrodes with a voltage to periodically switch electrical fields therebetween, so that the toner particles form a cloud on the surface of the toner carrier while hopping.

9 Claims, 9 Drawing Sheets

DEVELOPMENT DEVICE AND IMAGE FORMING APPARATUS HAVING ELECTRODES THAT CAUSE TONER PARTICLES TO FORM A TONER CLOUD ON THE SURFACE OF THE TONER CARRIER

CROSS-REFERENCE TO RELATED APPLICATIONS

The present application is based on and claims priority from Japanese Patent Application No. 2007-130588, filed on May 16, 2007 in the Japan Patent Office, the entire contents of which are hereby incorporated herein by reference.

BACKGROUND OF THE INVENTION

1. Field of the Invention

Exemplary aspects of the present invention relate to a development device and an image forming apparatus, and more particularly, to a development device and an image forming apparatus for forming a high quality image without uneven image density.

2. Description of the Related Art

A related-art image forming apparatus, such as a copier, a facsimile machine, a printer, a plotter, or a multifunction printer having at least one of copying, printing, scanning, plotter, and facsimile functions, forms a toner image on a recording medium (e.g., a sheet) according to image data by electrophotography. For example, a charging device charges a surface of a latent image carrier. An optical writer emits a light beam onto the charged surface of the latent image carrier to form an electrostatic latent image on the latent image carrier according to the image data. A development device develops the electrostatic latent image with a developer (e.g., toner) to form a toner image on the latent image carrier. The toner image is transferred from the latent image carrier onto a sheet. A fixing device applies heat and pressure to the sheet bearing the toner image to fix the toner image on the sheet. Thus, the toner image is formed on the sheet.

Recently, in order to satisfy an increasing demand for full color image formation, an image forming apparatus may include a plurality of development devices to form toner images in colors different from each other. The toner images are superimposed on a latent image carrier to form a color toner image thereon.

One example of a related-art image forming apparatus includes development devices using a toner cloud development method. The development devices do not contact a latent image carrier and form a toner cloud between the latent image carrier and development rollers included in the development devices due to an effect of an alternating current electrical field generated by an alternating current voltage source. Toner particles in the toner cloud may be attracted to a latent image formed on the latent image carrier and used for development of the latent image. For example, while the latent image carrier bearing the latent image rotates, the development devices adhere toner particles in different colors, respectively, to the latent image on the latent image carrier. In other words, a toner image in one color may be superimposed on another toner image in a different color, thereby forming a full color toner image.

Another example of a related-art image forming apparatus includes a development device using an effect of an electrical field curtain. Such development device also does not contact a latent image carrier and forms the electrical field curtain between the latent image carrier and a development roller included in the development device by application of an alternating current voltage to electrodes. The electrical field curtain may convey toner particles to the latent image carrier so as to form a toner image thereon.

However, due to the alternating current electrical field formed between the latent image carrier and the development device, some toner particles may be removed from the toner image formed on the latent image carrier and return to an inside of the development device, resulting in a faulty image. In addition, the toner particles may be mixed with another toner particles in a different color.

Therefore, in order to form a high-quality full color toner image, there is a need for a technology to form a toner cloud without generating an alternating current electrical field between a latent image carrier and a development device.

BRIEF SUMMARY OF THE INVENTION

This specification describes a development device according to exemplary embodiments of the present invention. In one exemplary embodiment of the present invention, the development device includes a toner carrier, a toner supplier, and a surface electrical potential controller. The toner carrier is configured to oppose the latent image carrier and carry toner particles to be adhered to a latent image formed on the latent image carrier. The toner supplier is configured to supply the toner particles to the toner carrier and have a time constant $\tau 1$ of a surface electrical potential change of a surface of the toner carrier. The surface electrical potential controller is configured to control a surface electrical potential of the toner carrier and have a time constant $\tau 2$ of a surface electrical potential change of the surface of the toner carrier. The time constant $\tau 2$ is smaller than the time constant $\tau 1$. The toner carrier includes a plurality of electrodes and a voltage supplier. The plurality of electrodes are provided aligned in parallel on the surface of the toner carrier in a predetermined direction and electrically insulated from each other. The voltage supplier is configured to supply the plurality of electrodes with a voltage so as to periodically switch electrical fields between each electrode of the plurality of electrodes to cause the toner particles carried on the surface of the toner carrier to form a cloud while hopping on the surface of the toner carrier.

This specification further describes a development device according to exemplary embodiments of the present invention. In one exemplary embodiment of the present invention, the development device includes a toner carrier, a toner supplier, a toner collector, and a surface electrical potential controller. The toner carrier is configured to oppose the latent image carrier and carry toner particles to be adhered to a latent image formed on the latent image carrier. The toner supplier is configured to supply the toner particles to the toner carrier. The toner collector is configured to collect the toner particles from the toner carrier. The surface electrical potential controller is configured to control a surface electrical potential of the toner carrier and supplied with a bias. The toner carrier includes a plurality of electrodes and a voltage supplier. The plurality of electrodes are provided aligned in parallel on the surface of the toner carrier in a predetermined direction and electrically insulated from each other, and supplied with a bias having an average electrical potential substantially equal to an average electrical potential of the bias applied to the surface electrical potential controller. The voltage supplier is configured to supply the plurality of electrodes with a voltage so as to periodically switch electrical fields between each electrode of the plurality of electrodes to cause the toner particles carried on the surface of the toner carrier to form a cloud while hopping on the surface of the toner carrier.

This specification further describes an image forming apparatus according to exemplary embodiments of the present invention. In one exemplary embodiment of the present invention, the image forming apparatus includes a latent image carrier and a development device. The latent image carrier is configured to carry a latent image. The development device is configured to develop the latent image carried by the latent image carrier and includes a toner carrier, a toner supplier, and a surface electrical potential controller. The toner carrier is configured to oppose the latent image carrier and carry toner particles to be adhered to a latent image formed on the latent image carrier. The toner supplier is configured to supply the toner particles to the toner carrier and have a time constant $\tau 1$ of a surface electrical potential change of a surface of the toner carrier. The surface electrical potential controller is configured to control a surface electrical potential of the toner carrier and have a time constant $\tau 2$ of an electrical potential change of the surface of the toner carrier. The time constant $\tau 2$ is smaller than the time constant $\tau 1$. The toner carrier includes a plurality of electrodes and a voltage supplier. The plurality of electrodes are provided aligned in parallel on the surface of the toner carrier in a predetermined direction and electrically insulated from each other. The voltage supplier is configured to supply the plurality of electrodes with a voltage so as to periodically switch electrical fields between each electrode of the plurality of electrodes to cause the toner particles carried on the surface of the toner carrier to form a cloud while hopping on the surface of the toner carrier.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
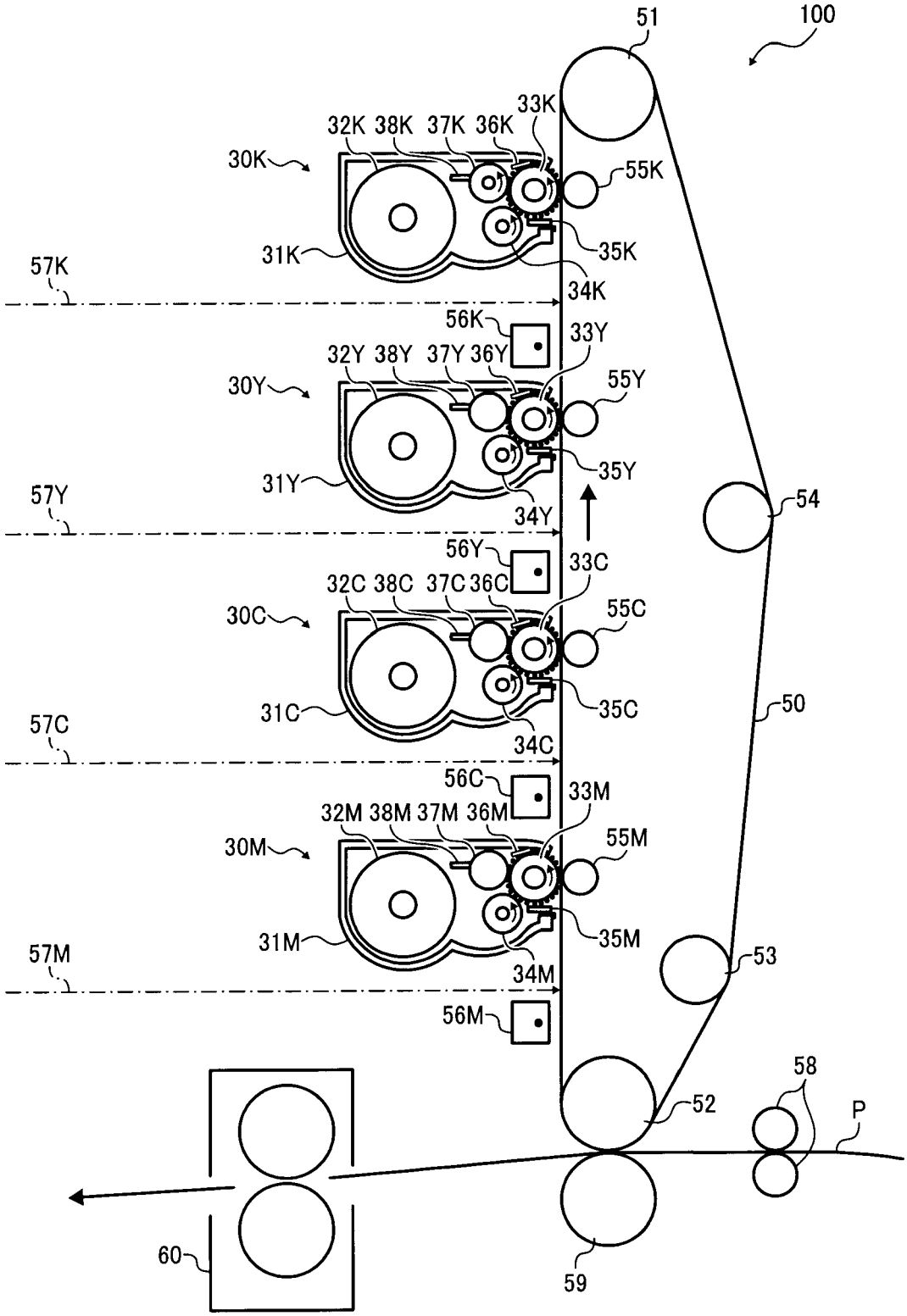
FIG. 1 is a sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is described.

The image forming apparatus 100 includes a photoconductor 50, a plurality of rollers 51, 52, 53, and 54, development devices 30M, 30C, 30Y, and 30K, chargers 56M, 56C, 56Y, and 56K, primary transfer rollers 55M, 55C, 55Y, and 55K, a registration roller pair 58, a secondary transfer roller 59, and a fixing device 60. The development devices 30M, 30C, 30Y, and 30K include casings 31M, 31C, 31Y, and 31K, agitators 32M, 32C, 32Y, and 32K, flare rollers 33M, 33C, 33Y, and 33K, supply rollers 34M, 34C, 34Y, and 34K, toner thickness controllers 35M, 35C, 35Y, and 35K, sealing members 36M, 36C, 36Y, and 36K, collecting rollers 37M, 37C, 37Y, and 37K, and flickers 38M, 38C, 38Y, and 38K, respectively.

The image forming apparatus 100 may be a copier, a facsimile machine, a printer, a plotter, a multifunction printer having at least one of copying, printing, scanning, plotter, and facsimile functions, or the like. According to this non-limiting exemplary embodiment, the image forming apparatus 100 forms a full color toner image by superimposing magenta, cyan, yellow, and black toner images on each other on the photoconductor 50. However, the image forming apparatus 100 is not limited to the full color image forming apparatus and may form a color and/or monochrome image with other structure.

The photoconductor 50, having an endless belt shape and serving as a latent image carrier, is looped over the plurality of rollers 51, 52, 53, and 54, and driven to rotate by a driver (not shown).

The development devices 30M, 30C, 30Y, and 30K oppose the photoconductor 50 and form magenta, cyan, yellow, and black toner images, respectively.

When the photoconductor 50 is uniformly charged by the charger 56M and exposed to a light beam 57M modulated from magenta image data by a writer (not shown), serving as an exposure device, an electrostatic latent image is formed on the photoconductor 50. The development device 30M develops the electrostatic latent image to form a magenta toner image. After the primary transfer roller 55M transfers the magenta toner image onto the photoconductor 50, a discharger (not shown) discharges the photoconductor 50 to prepare for subsequent image formation.

Thereafter, when the photoconductor 50 is uniformly charged by the charger 56C and exposed to a light beam 57C modulated from cyan image data by the writer, an electrostatic latent image is formed on the photoconductor 50. The development device 30C develops the electrostatic latent image to form a cyan toner image to be superimposed on the magenta toner image. After the primary transfer roller 55C transfers the cyan toner image onto the photoconductor 50, the discharger discharges the photoconductor 50 to prepare for subsequent image formation.

Thereafter, when the photoconductor 50 is uniformly charged by the charger 56Y and exposed to a light beam 57Y modulated from yellow image data by the writer, an electrostatic latent image is formed on the photoconductor 50. The development device 30Y develops the electrostatic latent image to form a yellow toner image to be superimposed on the magenta toner image and the cyan toner image. After the primary transfer roller 55Y transfers the yellow toner image onto the photoconductor 50, the discharger discharges the photoconductor 50 to prepare for subsequent image formation.

Thereafter, when the photoconductor 50 is uniformly charged by the charger 56K and exposed to a light beam 57K modulated from black image data by the writer, an electrostatic latent image is formed on the photoconductor 50. The development device 30K develops the electrostatic latent image to form a black toner image to be superimposed on the magenta toner image, the cyan toner image, and the yellow toner image. The primary transfer roller 55K transfers the black toner image onto the photoconductor 50, thereby forming a full color toner image.

After a feeding device (not shown) feeds a recoding medium P (e.g., a recording sheet), the recording medium P is aligned by the registration roller pair 58 and conveyed to a secondary transfer portion at a predetermined timing. When the secondary transfer roller 59 is supplied with a transfer bias from a power supply, the secondary transfer roller 59 transfers the full color toner image formed on the photoconductor 50 onto the recording medium P.

After the fixing device 60 fixes the full color toner image on the recording medium P, the recording medium P bearing the fixed full color toner image is discharged to an outside of the image forming apparatus 100. After the full color toner image is transferred to the recording medium P, a cleaner (not shown) removes residual toner, and the like, remaining on the photoconductor 50.

According to this exemplary embodiment, the magenta, cyan, yellow, and black toner images may be superimposed on each other onto a single photoconductor, that is, the photoconductor 50 to form the full color toner image on the photoconductor 50. Therefore, compared to a tandem type image forming apparatus in which magenta, cyan, yellow, and black toner images are formed on four photoconductors, respectively, the magenta, cyan, yellow, and black toner images may be superimposed on the photoconductor 50 more precisely without being shifted from each other. Thus, the image forming apparatus 100 may form a high-quality full color toner image.

Moreover, according to this exemplary embodiment, the flare rollers 33M, 33C, 33Y, and 33K do not contact the photoconductor 50, preventing wear of the photoconductor 50 and thereby providing improved durability of the photoconductor 50. Further, no alternating current electrical field is formed in a vicinity of each development area of the photoconductor 50. Thus, a subsequent development process does not mechanically and electrically affect a toner image already formed on the photoconductor 50, preventing scavenging, color mixing, or the like, and thereby enabling formation of a high-quality image stably over a long period of time. In other words, the development devices 30M, 30C, 30Y, and 30K develop the electrostatic latent image on the photoconductor 50 without contacting the photoconductor 50, and a direct current electric field generates near the electrostatic latent image. Accordingly, the magenta, cyan, yellow, and black toner images may be superimposed on the photoconductor 50, forming a high-quality full color image without image shift with a simple structure.

Figure 2:
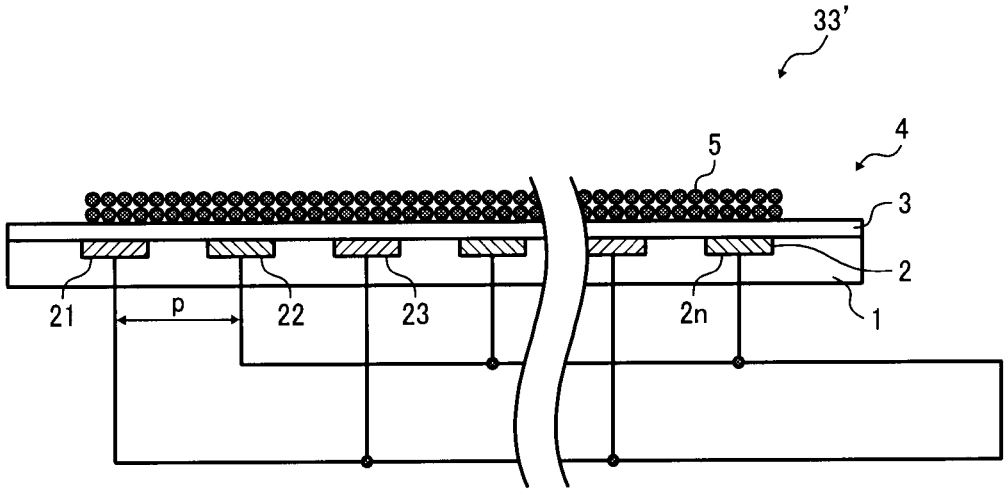
FIG. 2 is a schematic view of an experimental model of a flare roller before a flare is generated.
Figure 3:
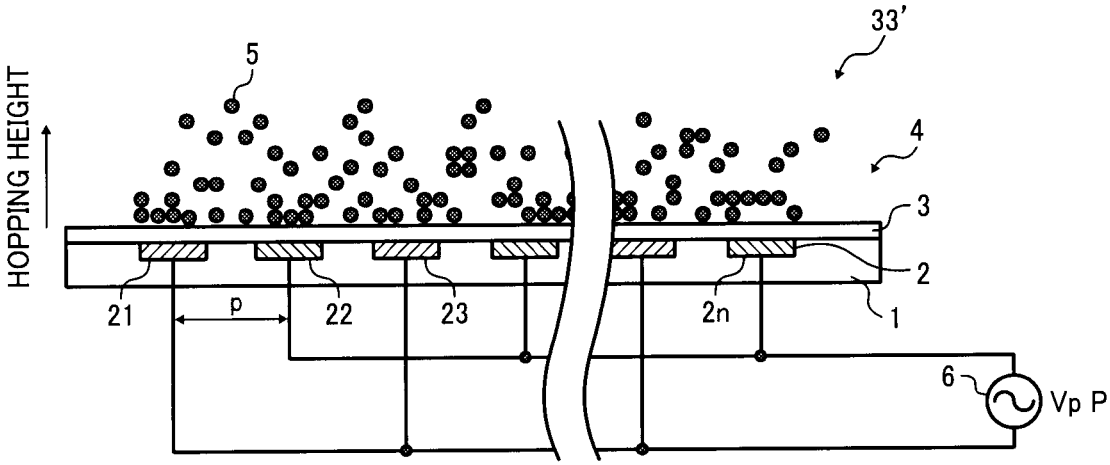
FIG. 3 is a schematic view of the flare roller shown in FIG. 2 when the flare is generated.

Referring to FIGS. 2 and 3, a description is now given of a principle of a flare development method for developing a latent image by forming a toner cloud by hopping toner particles. FIG. 2 is a schematic view of an experimental model of a flare roller 33'. FIG. 3 is a schematic view of the flare roller 33' when a toner cloud is generated. As illustrated in FIG. 2, the flare roller 33' includes a substrate 4. The substrate 4 includes a glass substrate 1, an electrode pattern 2, and a protection layer 3. The electrode pattern 2 includes a plurality of electrodes 21, 22, 23, . . . 2*n*.

When aluminum is evaporated onto the glass substrate 1, the electrode pattern 2 including the plurality of electrodes 21, 22, 23, . . . 2*n* arranged at a pitch p μm in a direction of movement of the photoconductor 50 (depicted in FIG. 1) is formed. The resin-coated protection layer 3 is provided thereon to form the substrate 4, serving as a toner carrier. On the substrate 4 is formed a charged toner layer 5. The toner layer 5 is a thin layer of toner particles forming a solid image formed by a two-component development device (not shown) on the substrate 4.

As illustrated in FIG. 3, the flare roller 33' further includes an alternating-current power supply 6. When the alternating-current power supply 6, serving as a voltage supplier, supplies a group of odd number electrodes 21, 23, . . . with an alternating voltage, while supplying a group of even number electrodes 22, . . . with an alternating voltage having a polarity opposite to a polarity of the alternating voltage supplied to the group of odd number electrodes 21, 23, . . . , toner particles of the toner layer 5 start hopping, such that the toner particles move back and forth between the group of odd number electrodes 21, 23, . . . and the group of even number electrodes 22, . . . , thereby forming a toner cloud, which is referred to as a "flare" according to this exemplary embodiment.

This formation of the flare when the substrate 4 faces the photoconductor 50, serving as a latent image carrier, may cause the toner particles to adhere to the latent image formed on the photoconductor 50 and develop the latent image. Such development method is called a "flare development", and a roller shaped toner carrier (e.g., the flare rollers 33M, 33C, 33Y, and 33K depicted in FIG. 1) used for the flare development is called a "flare roller" according to this exemplary embodiment.

Figure 4:
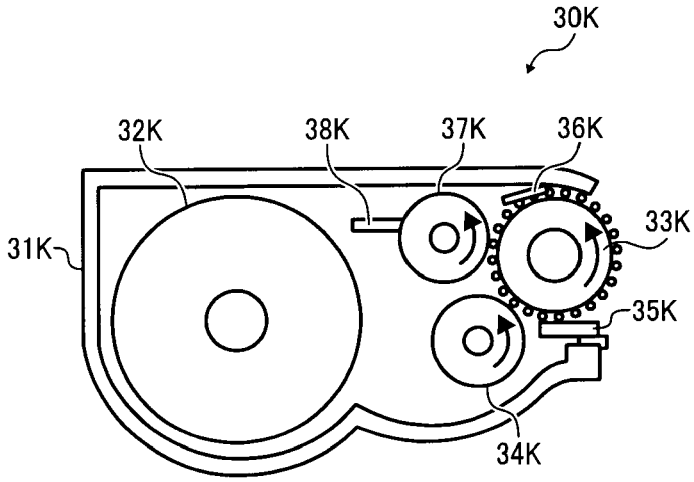
FIG. 4 is a sectional view of a development device included in the image forming apparatus shown in FIG. 1.

Referring to FIGS. 4 to 7, a description is now given of the flare development method. FIG. 4 is an enlarged schematic view of the development device 30K using the flare development method according to this exemplary embodiment. The development devices 30M, 30C, and 30Y (depicted in FIG. 1) have a structure equivalent to that of the development device 30K, and therefore redundant descriptions thereof are omitted hereinafter.

The casing 31K stores a developer (e.g., toner). The agitator 32K agitates the toner in the casing 31K. The flare roller 33K, serving as a toner carrier, opposes the photoconductor 50 (depicted in FIG. 1). The supply roller 34K, serving as a toner supplier, is provided upstream from the flare roller 33K in a direction of rotation (e.g., a toner conveyance direction) of the flare roller 33K and supplies the flare roller 33K with the toner. The toner thickness controller 35K controls thickness of the toner supplied to the flare roller 33K. The sealing member 36K seals a gap between the flare roller 33K and the casing 31K. The collecting roller 37K, serving as a surface electrical potential controller and a toner collector, is provided downstream from the flare roller 33K in the direction of rotation (e.g., the toner conveyance direction) of the flare roller 33K. The flicker 38K scraps the toner adhered to the collecting roller 37K.

Figure 5:
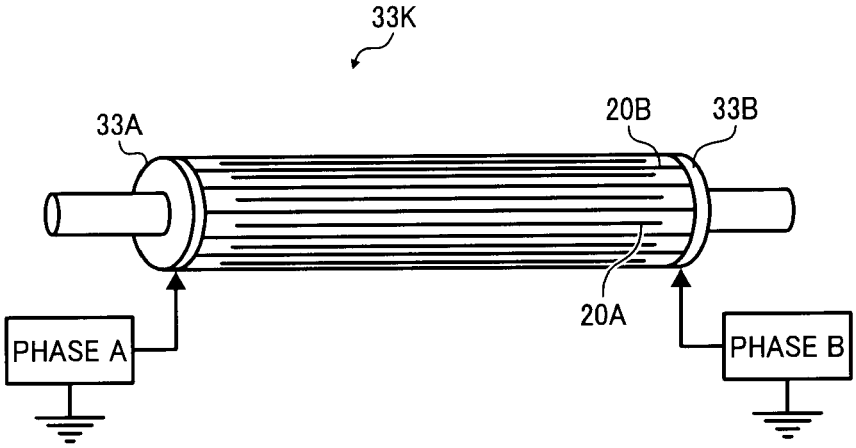
FIG. 5 is a perspective view of a flare roller included in the development device shown in FIG. 4.
Figure 6:
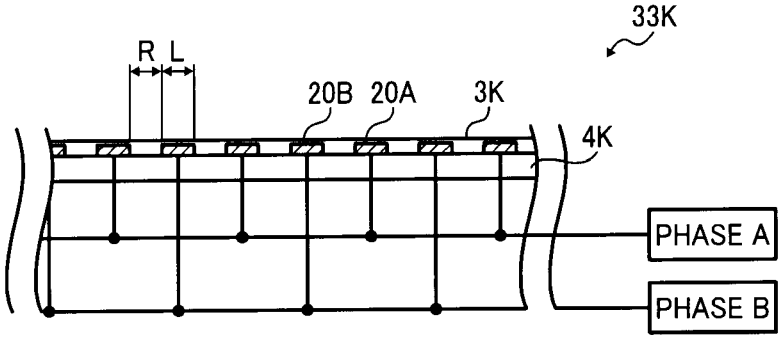
FIG. 6 is a partial sectional view of the flare roller shown in FIG. 5 in a direction perpendicular to a longitudinal direction of the flare roller.
Figure 7:
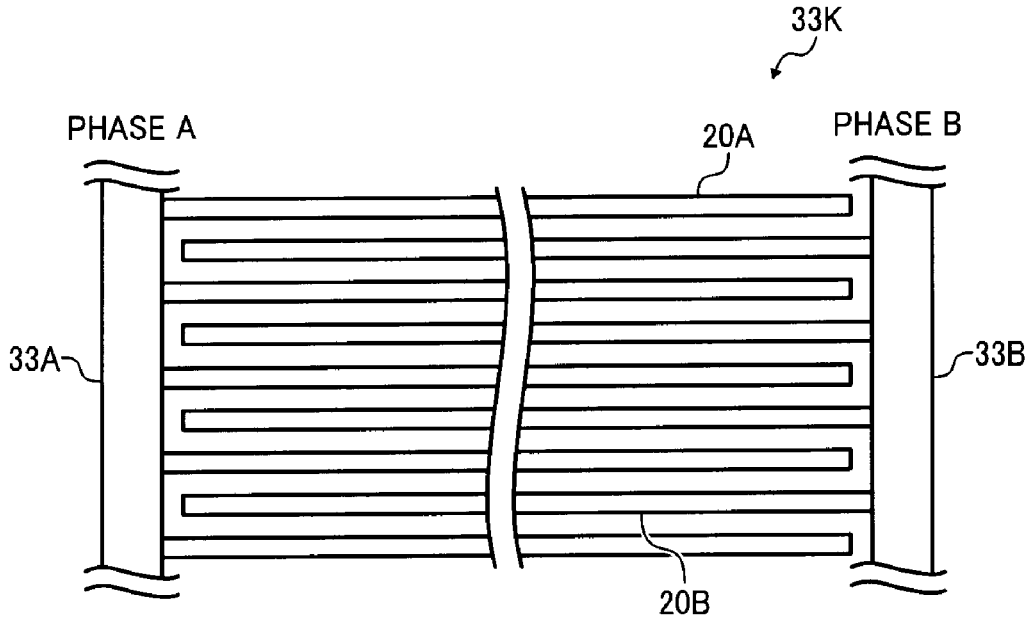
FIG. 7 is a plan view of the flare roller shown in FIG. 6.

FIG. 5 is a perspective view of the flare roller 33K according to this exemplary embodiment. FIG. 6 is a sectional view of the flare roller 33K in a circumferential direction perpendicular to a longitudinal direction of the flare roller 33K. FIG. 7 is a plan view of the flare roller 33K. The flare rollers 33M, 33C, and 33Y (depicted in FIG. 1) have a structure equivalent to that of the flare roller 33K.

As illustrated in FIG. 5, the flare roller 33K includes common electrodes 33A and 33B, and a plurality of electrodes 20A and 20B.

The common electrode 33A is circumferentially provided in one end of the flare roller 33K in an axial direction of the flare roller 33K and supplies the plurality of electrodes 20A with a voltage of a phase A, while the common electrode 33B is circumferentially provided in another end of the flare roller 33K in the axial direction of the flare roller 33K and supplies the plurality of electrodes 20B with a voltage of a phase B opposite to the phase A. As illustrated in FIG. 7, the plurality of electrodes 20A and 20B extend from the common electrodes 33A and 33B and is alternately provided in the circumferential direction of the flare roller 33K, so as to oppose each other in the axial direction of the flare roller 33K.

As illustrated in FIG. 6, the flare roller 33K further includes a supporting substrate 4K and a surface protection layer 3K.

The electrodes 20A and 20B are provided at a predetermined distance on the supporting substrate 4K, and the surface protection layer 3K is formed thereover and includes an organic or inorganic insulating material.

Lines extending from the respective electrodes 20A and 20B represent conductive lines for supplying the respective electrodes 20A and 20B with a voltage. A black circle portion of the respective lines in which the respective lines overlap each other is electrically connected, while the other portions are electrically insulated.

Therefore, driving voltages of two different phases (e.g., phases A and B) are applied by a power supply of the development device 30K (depicted in FIG. 4) to the common electrodes 33A and 33B (depicted in FIG. 5) via a brush contact member (not shown).

As illustrated in FIG. 7, the flare roller 33K includes two groups of electrodes 20A and 20B for generating an electrical field for causing the toner particles to hop on the flare roller 33K. Respective driving circuits (not shown) supply the group of even number electrodes and the group of odd number electrodes with driving waveforms described later in FIGS. 8A and 8B, thereby generating a time-periodical potential difference between the two groups of electrodes.

The flare roller 33K is driven to rotate, with one end of a rotation axis of the flare roller 33K being connected to an odd number electrode (e.g., the common electrode 33A), while another end thereof being connected to an even number electrode (e.g., the common electrode 33B).

Therefore, the toner particles supplied to the flare roller 33K from the supply roller 34K (depicted in FIG. 4) start hopping according to the periodically changing electrical field. The rotation of the flare roller 33K conveys the toner particles to an area facing the photoconductor 50, serving as a latent image carrier. Due to an electrical force of an electrical field, the toner particles transfer onto the latent image formed on the photoconductor 50 and develop the latent image.

By contrast, when the toner particles do not transfer to the photoconductor 50, the flare roller 33K conveys them to an area facing the collecting roller 37K (depicted in FIG. 4). Since the toner particles hopping on the flare roller 33K may hardly adhere to the flare roller 33K, they may be collected by the collecting roller 37K easily. Thereafter, when the flare roller 33K opposes the supply roller 34K, the supply roller 34K supplies the flare roller 33K with new toner particles. Repetition of supply and collection of the toner particles may cause a predetermined amount of toner particles to constantly hop on the flare roller 33K.

The supporting substrate 4K (depicted in FIG. 6) of the flare roller 33K may include a substrate including an insulating material such as a glass substrate, a resin substrate, a ceramics substrate, and the like, a substrate including a conductive material such as SUS (stainless steel) on which an insulating film such as $SiO_2$ (silicon dioxide) and the like is formed, and a substrate including a polyimide and the like.

The electrodes 20A and 20B each is formed by forming a conductive material such as Al (aluminum), Ni—Cr (nickel-chromium), and the like with a thickness of from about 0.1 μm to about 10 μm, and more preferably from about 0.5 μm to about 2.0 μm on the supporting substrate 4K, and formed into a desired shape in a pattern by using a photolithographic technique.

As illustrated in FIG. 6, an electrode width L and an electrode gap R in the flare roller 33K substantially affect hopping efficiency of toner particles. An electrode pitch P is represented by a following formula (1):

$$P=R+L \tag{1}$$

When the toner particles remain in a gap between the electrodes 20A and 20B, an electrical field in a substantially horizontal direction moves the toner particles to the adjacent electrodes 20A and 20B on the supporting substrate 4K. By contrast, most of the toner particles being on the electrodes 20A and 20B may fly to separate from a surface of the supporting substrate 4K at an initial velocity having at least a vertical component.

In particular, since the toner particles being around an edge surface of the electrodes 20A and 20B jump over the adjacent electrodes 20A and 20B, when the electrode width L is large, the increasing amount of the toner particles being on the electrodes 20A and 20B may move for a long distance. However, when the electrode width L is too large, an electrical field strength around a center of the electrodes 20A and 20B may decrease, thereby the toner particles may adhere to the electrodes 20A and 20B, resulting in reduction of hopping efficiency.

According to this exemplary embodiment, the toner particles may efficiently hop on the flare roller 33K at a decreased voltage when the electrodes 20A and 20B of the flare roller 33K have an appropriate width for toner particles to hop.

Since the electrical field strength is determined based on a relation between a distance and an applied voltage, the smaller the electrode gap R is, the larger the electrical field strength is, so that the toner particles may obtain an initial velocity of hopping. However, when the toner particles move from the electrode 20A to the electrode 20B, or from the electrode 20B to the electrode 20A, a movement distance of the toner particles may be shortened. Accordingly, a period of hopping time may be shortened unless a drive frequency increases. However, according to this exemplary embodiment, the toner particles may be efficiently conveyed and may hop on the flare roller 33K at a decreased voltage when the electrode gap R of the flare roller 33K is appropriate for the toner particles to hop on the flare roller 33K.

In addition, a thickness of the surface protection layer 3K over the surfaces of the electrodes 20A and 20B may also affect the electrical field strength of the surface of the electrodes 20A and 20B, and in particular, the thickness thereof may substantially affect a line of electric force of a vertical component and the toner hopping efficiency.

That is, by appropriately setting the electrode width L, the electrode gap R, and the thickness of the surface protection layer 3K, the toner particles may efficiently hop on the flare roller 33K at a decreased voltage.

According to this exemplary embodiment, the electrode width L may be not smaller than one time and not larger than 20 times an average particle size of the toner particles. The electrode distance R may be not smaller than one time and not larger than 20 times the average particle size of the toner particles.

Figure 8A:
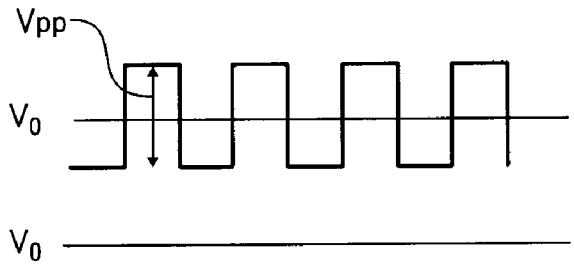
FIG. 8A is a waveform chart of driving waveforms of voltages applied to the flare roller shown in FIG. 7.
Figure 8B:
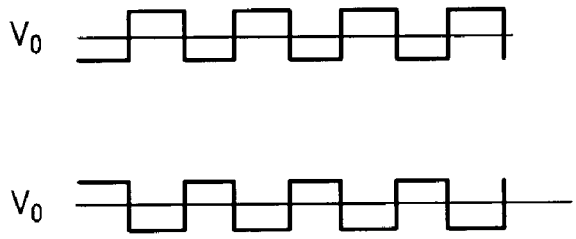
FIG. 8B is a waveform chart of driving waveforms of voltages applied to the flare roller shown in FIG. 7.

Referring to FIGS. 8A and 8B, a description is now given of a driving waveform of a voltage applied to the electrodes 20A and 20B of the flare roller 33K (depicted in FIG. 7). FIGS. 8A and 8B illustrate driving waveforms of voltages applied to the electrodes 20A and 20B of the flare roller 33K.

According to this exemplary embodiment, the driving waveforms of the voltages applied to the electrodes 20A and 20B include a rectangular wave alternately turned by 180 degrees, that is, a rectangular wave in which adjacent phases are shifted from each other by 180 degrees, as illustrated in FIG. 8B. However, as illustrated in FIG. 8A, even when a predetermined voltage is constantly applied to one of the electrodes 20A and 20B, while a rectangular wave voltage is applied to another one of the electrodes 20A and 20B, the toner particles may hop on the flare roller 33K.

In addition, the voltage applied to the electrodes 20A and 20B of the flare roller 33K may not have a rectangular wave, but may have a driving waveform such as a triangular wave, or the like, having a time constant. Alternatively, when a sine wave corresponding to the time constant is used as the driving waveform, the toner particles may substantially hop on the flare roller 33K.

The surface protection layer 3K (depicted in FIG. 6) may include $SiO_2$ (silicon dioxide), $BaTiO_2$ (barium titanium dioxide), $TiO_2$ (titanium dioxide), $TiO_4$ (titanium tetraoxide), SiON (silicon oxynitride), BN (boron nitride), TiN (stannum), and $Ta2O_5$ (tantalum pentoxide), and may have a thickness of from about 0.5 μm to about 10 μm, and more preferably from about 0.5 μm to about 3 μm.

SiO2, or the like, may be coated with an organic material such as a polycarbonate, and the like, or may be coated with a zirconia or a material generally used for coating a carrier of a two-component developer such as a silicon series resin or the like. The surface protection layer 3K may be appropriately selected based on an insulation property, durability, a manufacturing method of the flare roller 33K, and a relation with the toner in triboelectric series.

In order to use the development device 30K in the image forming apparatus 100 (depicted in FIG. 1), the flare roller 33K needs to include a fine pattern having a width of at least about 21 cm corresponding to a horizontal width (e.g., a short width) of a A4 size sheet, a large width not less than or equal to about 30 cm, or a large area.

There are some methods for manufacturing the flare roller 33K.

One of the manufacturing methods is forming a flexible electrode pattern and wrapping it around a holding drum to provide the flare roller 33K.

In order to form a substrate having a flexible fine pitch thin layer electrode, for example, a polyimide base film with a thickness of from about 20 μm to about 100 μm is provided as a base material (e.g., the supporting substrate 4K depicted in FIG. 6), and by using an evaporation method, Cu (copper), Al (aluminum), Ni—Cr (nickel-chromium), and the like, with a thickness of from about 0.1 μm to about 0.3 μm is formed thereon. A roll-to-roll machine may manufacture the substrate with a width of from about 30 cm to about 60 cm, thereby substantially increasing mass productivity. Simultaneously, a common bus-line may form the electrode with a width of from about 1 mm to about 5 mm.

Specifically, the evaporation method may include a sputtering method, an ion plating method, a CVD method, and an ion beam method. For example, when the electrode is formed by the sputtering method, a Cr (chromium) film may be provided in order to improve adhesiveness to the polyimide, or plasma processing or primer processing may improve the adhesiveness.

Other than the evaporation method, an electrodeposition method may provide the thin layer electrode. An electrode is formed on the polyimide base material by electroless plating. After the electrode is sequentially soaked in tin chloride, palladium chloride, and nickel chloride, so as to form a base electrode, it is subjected to electroplating to form a Ni film with a thickness of from about 1 μm to about 3 μm by using the roll-to-roll manufacturing machine.

After the thin film electrode undergoes resist coating, patterning, and etching, the electrodes 20A and 20B are formed. Photolithographic processing and etching processing may precisely form the thin film electrode with a thickness of from about 0.1 μm to about 3 μm having a width or a pitch of a fine pattern electrode of from about 5 μm to about dozens of μm.

Subsequently, $SiO_2$, $BaTiO_2$, $TiO_2$, or the like, with a thickness of from about 0.5 μm to about 2 μm is formed as the surface protection layer 3K by the sputtering method, or the like. Alternatively, a roll coater or other coating machines may apply a coat of P1 (polyimide) with a thickness of from about 2 μm to about 5 μm as the surface protection layer 3K and the surface protection layer is baked. When another layer is needed on the polyimide layer, $SiO_2$ or other inorganic film with a thickness of from about 0.1 μm to about 0.5 μm may be provided on an uppermost surface by the sputtering method, and the like. In addition, an organic material such as a polycarbonate, and the like may be applied to the surface protection layer 3K including SiO2, $BaTiO_2$, and $TiO_2$. Alternatively, a zirconia or a material generally used for coating a carrier of a two-component developer such as a silicon series resin, or the like may be used.

The above-described flexible substrate may be attached to a cylindrical drum or may form a partially curved surface.

As another example, after provision of a polyimide base film with a thickness of from about 20 μm to about 100 μm as a base material (e.g., the supporting substrate 4K), a metal material such as Cu, SUS, or the like, with a thickness of from about 10 μm to about 20 μm may be provided thereon as an electrode material. Thereafter, the roll coater applies a coat of a polyimide with a thickness of from about 20 μm to about 100 μm to the metal material. After being baked, the metal material is patterned into a shape of an electrode by photolithographic processing and etching processing, and a polyimide is coated over an electrode surface to serve as a protection layer. The electrode surface is planarized when it has irregularities due to the thickness of the electrode of from about 20 μm to about 100 μm.

For example, by spin-coating a polyimide series material or a polyurethane series material having a viscosity of from about 50 cps to about 10,000 cps, or more preferably from about 100 cps to about 300 cps and leaving it alone, surface tension of the material may smooth the irregularities on the substrate, thereby planarizing the uppermost surface of the flexible substrate.

As another example of an enhanced flexible substrate, after a metal material such as SUS, Al, and the like, having a thickness of from about 20 μm to about 30 μm is provided as a base material, the roll coater applies a coat of a diluted polyimide material with a thickness of about 5 μm to a surface of the base material as an insulation layer for insulating an electrode from the base material. For example, the polyimide material is pre-baked at about 150 degrees centigrade for about 30 minutes and post-baked at about 350 degrees centigrade for about 60 minutes, so as to form a thin polyimide film. Thus, the supporting substrate 4K is formed.

After being subjected to plasma processing and primer processing in order to improve adhesive force, Ni—Cr with a thickness of from about 0.1 μm to about 0.2 μm, serving as a thin electrode layer, is evaporated, so as to form a fine pattern electrode having a thickness of about dozens of μm by photolithographic processing and etching processing. Thereafter, as the surface protection layer 3K, $SiO_2$, $BaTiO_2$, $TiO_2$, or the like, with a thickness of from about 0.5 μm to about 1 μm is formed by the sputtering method, thereby obtaining a flexible substrate.

An organic material such as polycarbonate and the like may be applied to the surface protection layer including $SiO_2$, $BaTiO_2$, $TiO_2$, or the like. Alternatively, a zirconia or a material generally used for coating a carrier of a two-component developer such as a silicon series resin, or the like may be used.

Referring to FIGS. 9A to 9E, a description is now given of another method for manufacturing the flare roller 33K in which a patterned electrode is formed on the cylindrical drum in advance to provide the surface protection layer.

FIGS. 9A to 9E are sectional views of a surface of the flare roller 33K as seen in a direction of a rotation axis of the flare roller 33K illustrating respective stages of a production process thereof.

Figure 9A:
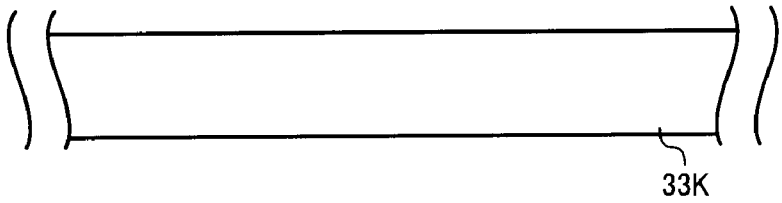
FIG. 9A is a sectional view of a surface of the flare roller shown in FIG. 7 in a stage of a production process.

As illustrated in FIG. 9A, in a production process stage S1, by turning an outer circumference surface of the flare roller 33K, the surface of the flare roller 33K becomes smooth.

Figure 9B:
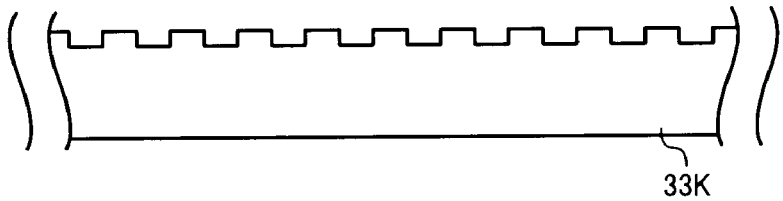
FIG. 9B is a sectional view of the surface of the flare roller shown in FIG. 9A in a subsequent stage of the production process.

As illustrated in FIG. 9B, in a production process stage S2, the surface of the flare roller 33K is cut to form grooves, each of which has a width of about 50 μm, arranged at a pitch of about 100 μm on the surface of the flare roller 33K.

Figure 9C:
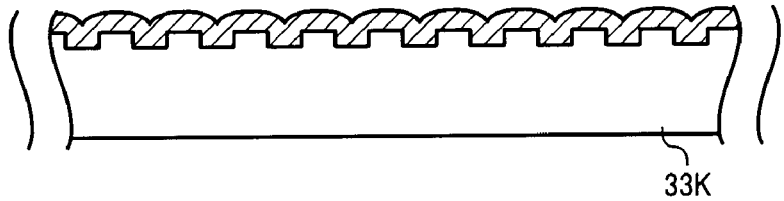
FIG. 9C is a sectional view of the surface of the flare roller shown in FIG. 9B in a subsequent stage of the production process.

As illustrated in FIG. 9C, in a production process stage S3, the flare roller 33K is subjected to electroless nickel plating.

Figure 9D:
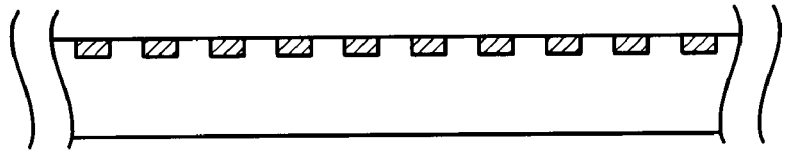
FIG. 9D is a sectional view of the surface of the flare roller shown in FIG. 9C in a subsequent stage of the production process.

As illustrated in FIG. 9D, in a production process stage S4, when an unnecessary conductor film is removed by turning the outer circumference surface of the flare roller 33K, the electrodes 20A and 20B are formed in the grooves.

Figure 9E:
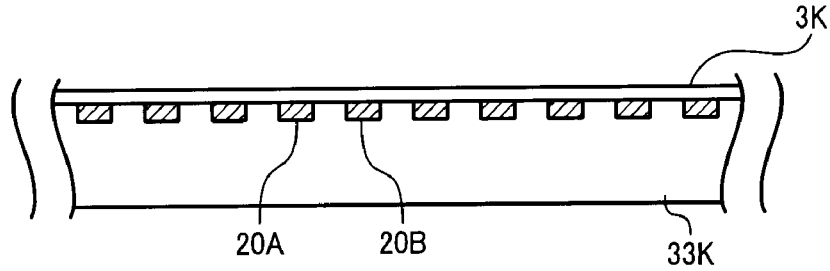
FIG. 9E is a sectional view of the surface of the flare roller shown in FIG. 9D in a subsequent stage of the production process.

As illustrated in FIG. 9E, in a production process stage S5, application of a coat of silicone series resin on the surface of the flare roller 33K may smooth the surface of the flare roller 33K, providing the surface protection layer 3K. The surface protection layer 3K may have a thickness of about 5 μm and a volume resistivity of about $10^{10}$ Ω·cm.

As yet another method for manufacturing the flare roller 33K, an electrode is printed and plated by screen printing and ink-jet printing using a conductive ink, and a non-electrode portion of the plated electrode is removed by laser processing.

It is to be noted that the method for manufacturing the flare roller 33K including the electrode pattern and the surface protection layer 3K is not limited to the above. The electrode material may include silver and copper.

Electrical capacitance measured between a connecting terminal (e.g., the common electrode 33A depicted in FIG. 5) of the phase A and a connecting terminal (e.g., the common electrode 33B depicted in FIG. 5) of the phase B is from about 900 pF to about 2,000 pF.

The toner particles may have an average particle size of from about 3 μm to about 12 μm. An amount of silica added to the toner may be preferably in a range of from about 1 parts by weight to about 5 parts by weight, such that an electrical charge is properly applied to the toner particles, that is, the toner may be supplied with a sufficient amount of electrical charge to hop on the flare roller 33K, but may not be supplied with an amount of electrical charge large enough to adhere to the flare roller 33K.

Referring to FIGS. 4, 10, 11, 12, 13, and 14, a description is now given of experiments using the flare roller 33K of the development device 30K.

A first experiment is performed as follows. Toner particles have a volume average particle size of 6 μm.

As illustrated in FIG. 4, when the agitator 32K (e.g., a paddle) agitates the toner particles stored in a toner accommodation part of the casing 31K, the toner particles are transferred to the supply roller 34K. The supply roller 34K includes a compressible sponge and is pressed against the flare roller 33K up to a depth of 0.5 mm into the sponge.

As the toner particles are supplied to the flare roller 33K, they are charged by friction. The rotation of the flare roller 33K conveys the toner particles to the toner thickness controller 35K, which includes an insulating rubber blade, for controlling an amount of toner supplied to the flare roller 33K.

After the amount of toner is controlled, the toner particles are uniformly supplied to the flare roller 33K while hopping and conveyed to a development area, so as to develop an electrostatic latent image formed on the photoconductor 50 (depicted in FIG. 1) in a non-contact state in which the flare roller 33K does not contact the photoconductor 50.

The collecting roller 37K, serving as a toner collector and a surface electrical potential controller, includes a compressible sponge and is pressed against the flare roller 33K up to a depth of 0.5 mm into the sponge. Toner particles that are not used in development are collected by the collecting roller 37K after passing through the development area and temporarily returned to the toner accommodation part of the casing 31K. Since the hopping toner particles have substantially decreased adhesive force, the collecting roller 37K is able to sufficiently collect the toner particles even when the collecting roller 37K is pressed slightly against the flare roller 33K. The collected toner particles are then mixed with other toner particles and subsequently again supplied to the flare roller 33K. It is to be noted that the collecting roller 37K is supplied with −200 V, which is equal to Vave, an average value of a bias applied to the flare roller 33K.

The flare roller 33K has a linear velocity of 300 mm/s, and the supply roller 34K has a linear velocity of 200 mm/s moving in a direction opposite to the flare roller 33K. The flare roller 33K is supplied with a rectangular-wave voltage with a frequency f of 1 kHz and a Vpp (peak to peak voltage) of 200 V, such that the phase A and the phase B are out of phase with each other by 180 degrees as illustrated in FIG. 8B. An offset voltage VO is set to −200 V. Since a duty ratio of the rectangular wave voltage is 50%, the average value Vave of the bias applied to the flare roller 33K is identical to the offset voltage VO.

The supply roller 34K is supplied with a DC (direct current) of −450 V and obtains a supply potential of 250 V.

Table 1 shows experimental conditions 1 to 6 of a type, a time constant τ1, depression in mm of the supply roller 34K serving as a toner supplier, and a diameter thereof, and a type, a time constant τ2, depression of the collecting roller 37K serving as a surface electrical potential controller and a toner collector, and a diameter thereof.

A high resistance roller has a resistance of $10^8\Omega$, and a low resistance roller has a resistance of $10^6\Omega$.

It is to be noted that resistances of the supply roller 34K and the collecting roller 37K are measured when they are supplied with a DC of −100 V and a load of 500 g on one side thereof, and placed on a metal roller with a diameter of 30 mm rotated at a speed of 30 rpm.

rotate for 90 seconds, an electrical potential behavior on a surface of the flare roller 33K is measured by an electrostatic voltmeter. Three biases, that is, DC biases of −250 V, 0 V, and +250 V, are applied, although the number of biases may be reduced since the time constants are substantially identical.

However, the electrical potential behavior when the supply bias is 0 V needs to be examined. This is because the electrical potential may vary due to factors other than charge injection, and thus the time constant needs to be obtained from the electrical potential behavior from which the behavior when the supply bias is 0 V is eliminated.

Figure 10:
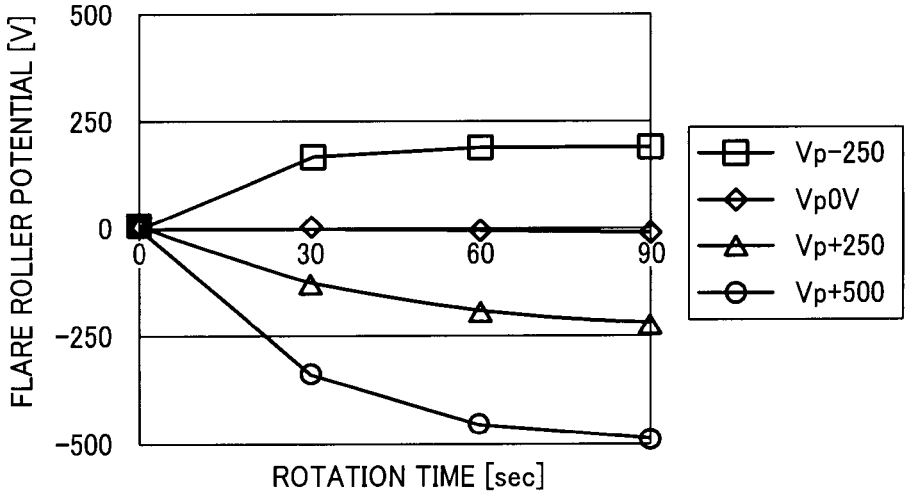
FIG. 10 is a graph illustrating a time transition of a surface potential of the flare roller shown in FIG. 7 when various voltages are applied to the flare roller.

As a result, an electrical potential profile like that illustrated in FIG. 10 is obtained. Since the charge injection is a characteristic that can be explained by an RC (resistance-capacitance) series circuit illustrated in FIG. 11, a time constant τ can be determined by the electrical potential profile obtained by the experiment.

Figure 11:
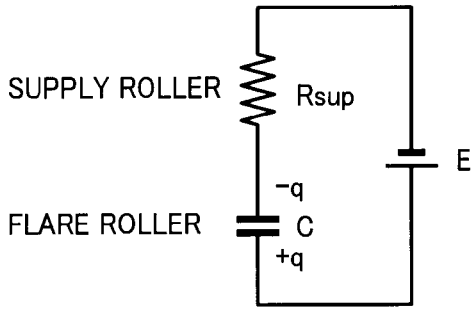
FIG. 11 is a circuit diagram of an RC (resistance-capacitance) series circuit of a capacitor model.

FIG. 10 is a graph of an electrical potential profile illustrating a relation between a potential of the flare roller 33K (depicted in FIG. 4) and a rotation time thereof when various voltages are applied to the flare roller 33K. FIG. 11 illustrates an RC series circuit of a capacitor model.

A surface potential of the flare roller 33K may be obtained by a following formula (2):

$$V(t) = E\left(1 - e^{\frac{t}{R_{sup}C}}\right) \tag{2}$$

where "$R_{sup}$" represents a resistance of the supply roller 34K (depicted in FIG. 4), "C" represents an electrostatic capacitance of the flare roller 33K, "E" represents an electrical potential difference between an average value of a flare bias

| | | Supply roller 34K | | | | Collecting roller 37K | | | |
|---|---|---|---|---|---|---|---|---|---|
| | Condition | Type | τ1 | Amount of depression [mm] | Diameter [mm] | Type | τ2 | Amount of depression [mm] | Diameter [mm] |
| Experiment 1 | 1 | A | 14 | 0.5 | 14 | B | 1.5 | 0.5 | 14 |
| Experiment 2 | 2 | A | 22 | 0.5 | 10 | A | 14 | 0.5 | 14 |
| Experiment 3 | 3 | A | 14 | 0.5 | 14 | A | 10 | 1.0 | 14 |
| Experiment 4 | 4 | A | 14 | 0.5 | 14 | C | 8 | 0.5 | 14 |
| Comparison 1 | 5 | B | 1.5 | 0.5 | 14 | A | 14 | 0.5 | 14 |
| Comparison 2 | 6 | A | 14 | 0.5 | 14 | D | 33 | 0.5 | 14 |

In table 1, type A represents a high resistance sponge roller, type B represents a low resistance sponge roller, type C represents a medium resistance fur brush roller, and type D represents a conducting blade.

A description is now given of a method of measurement of the time constant τ1 of the supply roller 34 injecting an electrical charge to the flare roller 33K and a method of measurement of the time constant τ2 of the collecting roller 37K changing an electrical charge of the flare roller 33K.

Under conditions of an amount of depression, a number of rotations, and the like equivalent to conditions under which the development device 33K is used in the image forming apparatus 100 (depicted in FIG. 1), only the supply roller 34K contacts the flare roller 33K and no toner is supplied thereto. An average value Vave of a flare bias applied to the flare roller 33K is set to 0 V.

When the flare roller 33K and the supply roller 34K are supplied with a flare bias and a supply bias, respectively, and and a supply bias, and "q" represents an electrical charge supplied to the flare roller 33K.

A time constant τ may be obtained by a following formula (3):

$$\tau = R_{sup}C \tag{3}$$

The obtained time constant τ indicates a charge injection characteristic represented by the graph in FIG. 10 showing the rotation time of the flare roller 33K on a horizontal axis. Although an actual charging time in which charge injection is performed is substantially short, the time constant τ is determined not based on the actual charging time but based on a parameter such as a diameter of the flare roller 33K, a width of a nip between the flare roller 33K and the supply roller 34K, and the like.

Similarly, the time constant τ2 of the collecting roller 37K (depicted in FIG. 4) changing an electrical charge of the flare roller 33K may be measured.

As a result, as illustrated in table 1, the time constant $\tau 1$ of the supply roller 34K is 14, and the time constant $\tau 2$ of the collecting roller 37K is 1.5, which satisfies a relation of $\tau 1 > \tau 2$.

Under the above conditions, when the flare roller 33K of the development device 30K (depicted in FIG. 4) continuously rotates, an amount of toner adhered to the flare roller 33K and an amount of charged toner after the toner thickness is controlled are kept constant.

Figure 12:
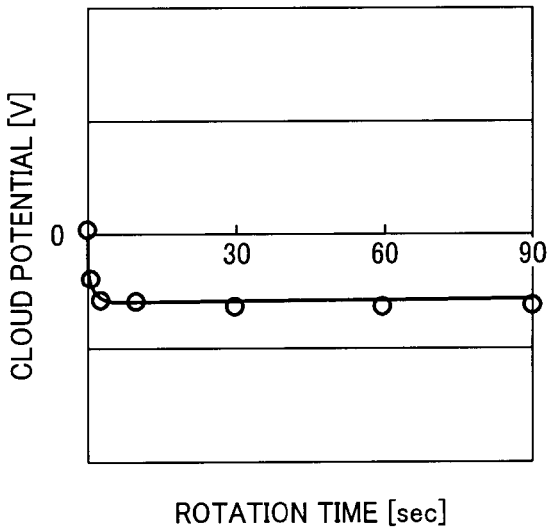
FIG. 12 is a graph illustrating a relation between a rotation time of the flare roller shown in FIG. 7 and a cloud potential.

FIG. 12 is a graph illustrating a relation between a rotation time of the flare roller 33K (depicted in FIG. 4) and a cloud potential. As illustrated in FIG. 12, a cloud potential of the flare roller 33K is kept constant after one rotation of the flare roller 33K. The cloud potential means a surface potential of the flare roller 33K when toner particles adhering to the flare roller 33K hop on the flare roller 33K with a flare bias applied thereto.

Since the cloud potential is kept constant, a potential difference between the cloud potential and a latent image potential on the photoconductor 50K (depicted in FIG. 1) may be kept constant, thereby enabling formation of a high quality image having a stable image density without background fouling.

That is, when a rate of a decrease in the surface potential of the flare roller 33K by the supply roller 34K is larger than a rate of an increase in the surface potential of the flare roller 33K by the collecting roller 37K ($\tau 1 > \tau 2$), the potential difference between the cloud potential and the latent image potential on the photoconductor 50K may be kept constant.

A description is now given of a second experiment. Condition 2 in table 1 shows that a sponge roller with a diameter of 10 mm is used as the supply roller 34K, and a sponge roller with a diameter of 14 mm including a material equivalent to that of the above sponge roller is used as the collecting roller 37K. When both sponge rollers are pressed with equal force against the flare roller 33K, one of the rollers having a smaller diameter than another one has a smaller nip portion contacting the flare roller 33K than another one has, and therefore, the time constant $\tau 1$ of charge injection becomes larger than the time constant $\tau 2$, thereby satisfying the relation of $\tau 1 > \tau 2$. Thus, even when the flare roller 33K continuously rotates, an amount of toner adhered to the flare roller 33K and an amount of charged toner after the toner thickness is controlled are kept constant. In addition, a cloud potential of the flare roller 33K is kept constant after one rotation of the flare roller 33K. Therefore, a potential difference between the cloud potential and a latent image potential on the photoconductor 50K may be kept constant, thereby enabling formation of a high quality image having a stable image density without background fouling.

A description is now given of a third experiment. Condition 3 in table 1 shows that the collecting roller 37K is pressed against the flare roller 33K up to a depth of 1.0 mm, and a width of a nip between the collecting roller 37K and the flare roller 33K is larger than a width of a nip between the supply roller 34K and the flare roller 33K.

Therefore, charge injection per rotation of the flare roller 33K takes a long time, thereby reducing the time constant $\tau 2$, satisfying the relation of $\tau 1 > \tau 2$. Thus, even when the flare roller 33K continuously rotates, an amount of toner adhered to the flare roller 33K and an amount of charged toner after the toner thickness is controlled are kept constant. In addition, a cloud potential of the flare roller 33K is kept constant after one rotation of the flare roller 33K. Therefore, a potential difference between the cloud potential and a latent image potential on the photoconductor 50K may be kept constant, thereby enabling formation of a high quality image having a stable image density without background fouling.

As shown in table 1, when a fourth experiment is performed using a fur brush as the collecting roller 37K instead of the sponge roller used as the supply roller 34K and the collecting roller 37K in the first, second, and third experiments, the relation of $\tau 1 > \tau 2$ is satisfied, thereby achieving sufficient potential control.

Alternatively, even when a fur brush is used as the supply roller 34K in a fifth experiment, the relation of $\tau 1 > \tau 2$ is satisfied, thereby achieving sufficient potential control.

Figure 13:
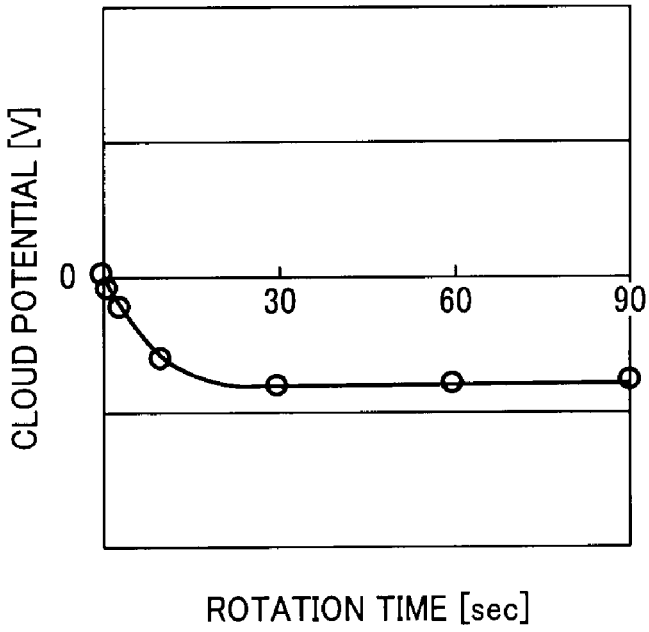
FIG. 13 is a graph illustrating a relation between a rotation time of the flare roller shown in FIG. 7 and a cloud potential.

A description is now given of a first comparison in which the supply roller 34K is replaced by the collecting roller 37K. FIG. 13 is a graph illustrating a relation between a rotation time of the flare roller 33K (depicted in FIG. 4) and a cloud potential. As illustrated in FIG. 13, the cloud potential continues to decrease for about 20 seconds after the flare roller 33K starts rotating. Since a proper development potential may not be maintained in a development area, image density increases, resulting in a faulty image with background fouling.

In addition, since an electrical potential for toner supply substantially decreases from an initial potential, a sufficient amount of toner may not be supplied to the flare roller 33K.

Consequently, although a desired image may be formed immediately after the flare roller 33K starts rotating since the surface potential of the flare roller 33K is 0, when the surface potential negatively increases (e.g., when the surface potential decreases below 0), the development potential, which is a difference between the surface potential of the flare roller 33K and the latent image potential of the photoconductor 50, increases, resulting in a faulty image with increased image density. This is because the flare roller 33K lacks potential control.

Figure 14:
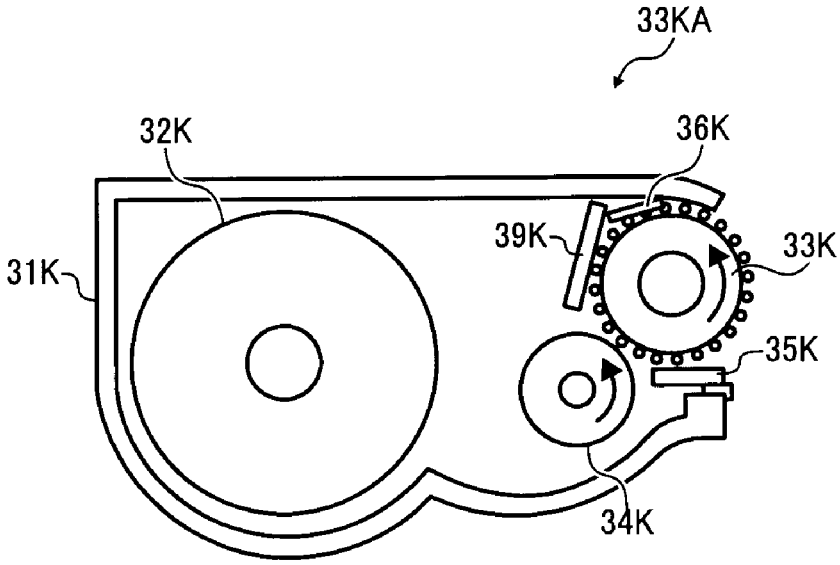
FIG. 14 is a schematic view of a comparison example of a development device.

A description is now given of a second comparison. FIG. 14 is a schematic view of a development device 30KA. The development device 30KA includes a conducting blade 39K instead of the collecting roller 37K and the flicker 38K depicted in FIG. 4. The other elements of the development device 30KA are common to the development device 30K depicted in FIG. 4.

The conducting blade 39K, serving as a surface electrical potential controller, is provided downstream from a development area and upstream from a toner supply area in the direction of rotation of the flare roller 33K, and supplied with a bias.

Since the conducting blade 39K has a blade shape, there is insufficient width of a nip between the conducting blade 39K and the flare roller 33K. Thus, a potential injection time is substantially shorter than the time of potential injection by the supply roller 34K, so that the conducting blade 39K may not sufficiently discharge the injected electrical charge to control the surface potential of the flare roller 33K.

However, the flare roller 33K and the collecting roller 37K may be supplied with a voltage of a polarity (e.g., a negative polarity) identical to that of the toner particles, and the flare roller 33K may have a larger electrical potential absolute value than that of the collecting roller 37K. For example, when the flare roller 33K has a potential $V_F$ of −200 V, and the collecting roller 37K has a potential $V_R$ of −100 V ($|V_F| > |V_R|$), the toner particles may be attracted to the collecting roller 37K.

Therefore, since a rate of toner collection from the flare roller 33K by the collecting roller 37K may increase, so as to change the surface potential of the flare roller 33K, the surface potential of the flare roller 33K may be controlled (e.g., discharged), thereby increasing an effect of discharging the flare roller 33K.

A description is now given of the fourth experiment using the rectangular wave (depicted in FIG. 8B) as a driving waveform for causing toner particles to hop. That is, both electrodes of two phases are supplied with a rectangular wave bias of an average value VO of −200 V, a frequency f of 1 kHz, and a peak to peak voltage Vpp of 300V. Also, the supply roller 34K (depicted in FIG. 4) is supplied with a DC bias VO of −200 V equal to that applied to the electrode of one phase.

Since a duty ratio of the rectangular wave voltage is 50%, the average value Vave of the bias applied to the flare roller 33K (depicted in FIG. 4) is identical to the offset voltage VO.

Alternatively, when the average value Vave of the bias applied to the flare roller 33K is not identical to the offset voltage VO since the duty ratio is not 50%, or the like, the collecting roller 37K (depicted in FIG. 4), serving as a surface electrical potential controller, is supplied with a bias of an average value Vave applied to the flare roller 33K, so that the bias applied to the collecting roller 37K may be identical to the supply bias.

The supply roller 34K and the collecting roller 37K include a sponge roller with a resistance of from $10^5\Omega$ to $10^7\Omega$.

It is to be noted that resistances of the supply roller 34K and the collecting roller 37K are measured when the supply roller 34K and the collecting roller 37K are supplied with a DC of −100 V and a load of 500 g on one side thereof, and placed on a metal roller with a diameter of 30 mm rotated at a rotation speed of 30 rpm.

Under the above conditions, when the flare roller 33K of the development device 30K (depicted in FIG. 4) continuously rotates, an amount of toner adhered to the flare roller 33K and an amount of charged toner after the toner thickness is controlled are kept constant.

In addition, as illustrated in FIG. 12, a cloud potential of the flare roller 33K is kept constant. Therefore, a potential difference between the cloud potential and a latent image potential on the photoconductor 50K may be kept constant, thereby enabling formation of a high-quality image having a stable image density without background fouling.

A description is now given of a comparison to the fourth experiment. Under conditions similar to the conditions for the fourth experiment, when the flare roller 33K is supplied with a bias equivalent to that applied to the flare roller 33K in the first experiment, and the collecting roller 37K, serving as a surface electrical potential controller, is supplied with a voltage of −400 V, the cloud potential continues to decrease for about 20 seconds after the flare roller 33K starts rotating, as illustrated in FIG. 13. Since a proper development potential may not be maintained in a development area, image density increases, resulting in a faulty image with increased image density and background fouling.

In addition, since an electrical potential for toner supply substantially decreases from an initial potential, a sufficient amount of toner may not be supplied to the flare roller 33K.

Consequently, although a desired image may be formed immediately after the flare roller 33K starts rotating since the surface potential of the flare roller 33K is 0, when the surface potential negatively increases (e.g., when the surface potential decreases below 0), the development potential, which is a difference between the surface potential of the flare roller 33K and the latent image potential of the photoconductor 50, increases, resulting in a faulty image with increased image density.

A description is now given of a fifth experiment using the rectangular wave (depicted in FIG. 8A) as a driving waveform for causing toner particles to hop. That is, one of the electrodes is supplied with a rectangular wave bias of an average value VO of −300 V, a frequency f of 1 kHz, and a peak to peak voltage Vpp of 600V, while the other electrode is supplied with a DC bias VO of −300 V.

Therefore, when one of the electrodes of two phases is constantly supplied with an even voltage while the other one is supplied with a rectangular wave voltage, the toner particles may hop on the flare roller 33K. Accordingly, since one of the biases applied to the flare roller 33K is a DC bias, one power supply system for generating a pulse may be reduced, resulting in a cost reduction of the power source.

The supply roller 34K is supplied with a DC bias of VO.

Therefore, since an average value of the bias applied to the supply roller 34K is equal to an average value of the bias applied to the flare roller 33K, the surface potential of the flare roller 33K may be kept constant, so that the cloud potential is kept constant even when the flare roller 33K continuously rotates, thereby enabling formation of a high-quality image without uneven image density.

A description is now given of a sixth experiment using the rectangular wave (depicted in FIG. 8B) as a driving waveform for causing toner particles to hop. That is, both electrodes of two phases are supplied with a rectangular wave bias of an average value VO of −300 V, a frequency f of 1 kHz, and a peak to peak voltage Vpp of 300 V but having phases opposite to each other.

Also, the supply roller 34K is supplied with a rectangular wave bias of an average value VO of −300 V, a frequency f2 of 500 Hz, and a peak-to-peak voltage V2 of 400 V.

Under the above conditions, when the flare roller 33K continuously rotates, a cloud potential of the flare roller 33K is kept constant, thereby enabling formation of a high-quality image without uneven image density.

A description is now given of a seventh experiment. The flare roller 33K is supplied with a flare bias having a driving waveform identical to the driving waveform used in the sixth experiment, and the supply roller 34K is supplied with a bias having a waveform equal to a waveform of the rectangular wave bias (e.g., phase A or phase B) applied to the flare roller 33K.

Under the above conditions, when the flare roller 33K continuously rotates, a cloud potential of the flare roller 33K is kept constant, thereby enabling formation of a high-quality image without uneven image density.

A description is now given of an eighth experiment using the rectangular wave (depicted in FIG. 8A) as a driving waveform for causing toner particles to hop. That is, one of the electrodes is supplied with a rectangular wave bias of an average value VO of −300 V, a frequency f of 1 kHz, and a peak to peak voltage Vpp of 600V, while the other electrode is supplied with a DC bias VO of −300 V.

The supply roller 34K is supplied with a rectangular wave bias equal to the rectangular wave bias applied to one electrode of one phase on one side of the flare roller 33K.

Under the above conditions, when the flare roller 33K continuously rotates, a cloud potential of the flare roller 33K is kept constant, thereby enabling formation of a high-quality image without uneven image density.

It is to be noted that although the fourth, fifth, sixth, seventh, and eighth experiments use a sponge roller as the supply roller 34K and the collecting roller 37K, at least one of the supply roller 34K and the collecting roller 37K may be replaced by a fur brush.

Referring to FIGS. 10, 11, 15, and 16, a description is now given of a result of the above experiments showing that provision of an improper potential controller may cause the surface potential of the flare roller 33K to fluctuate. A mechanism of such fluctuation is described below.

There are three factors liable to produce fluctuation of the surface potential of the flare roller 33K.

A first factor is an accumulation of an electrical charge by a condenser model.

FIG. 10 illustrates a result of measurement of chronological shifts in the surface potential of the flare roller 33K (depicted in FIG. 4). The measurement is performed by rotating the supply roller 34K (depicted in FIG. 4) and the flare roller 33K without supplying toner in order to extract an effect of the supply roller 34K and the flare roller 33K. The shifts in the surface potential of the flare roller 33K indicate the surface potential of the condenser generated by an electrical charge accumulated in the condenser in the RC series circuit (depicted in FIG. 11).

Specifically, the electrical charge accumulates in a surface protection layer of the flare roller 33K until there is no potential difference between the supply roller 34 and the flare roller 33K, so that the surface potential of the flare roller 33K is saturated.

After a power supply for generating the supply bias and the flare bias is powered off, the flare roller 33K gradually loses the electrical charge. However, since the surface protection layer of the flare roller 33K has a high resistance in order to provide insulation between the electrodes, the accumulated electrical charge is barely discharged. Therefore, a discharge function needs to be provided.

A second factor is a frictional charge between the flare roller 33K and the supply roller 34K.

Figure 15:
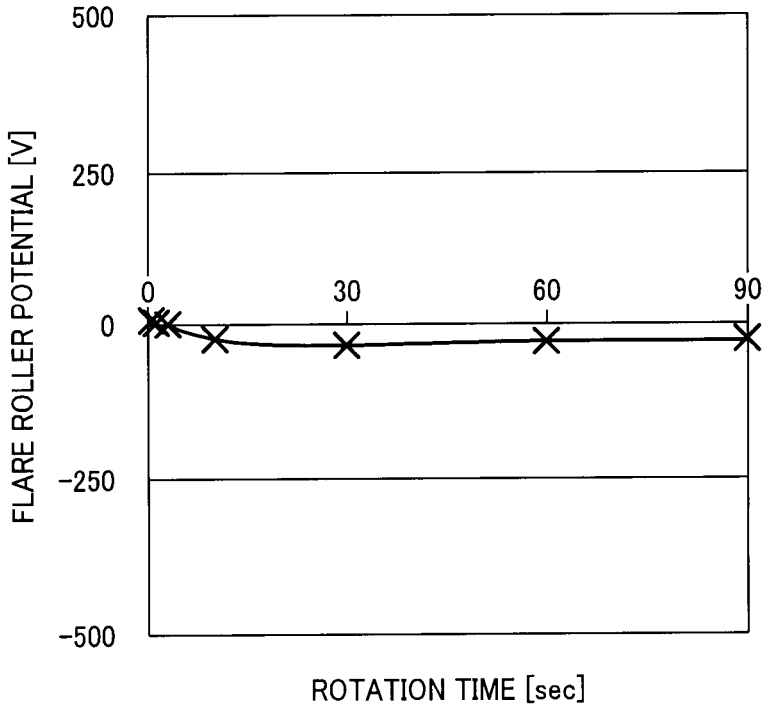
FIG. 15 is a graph illustrating a time transition of the surface potential of the flare roller shown in FIG. 7 when a supply bias and biases of two phases applied to the flare roller are grounded.

FIG. 15 is a graph illustrating a relation between a rotation time of the flare roller 33K and the surface potential of the flare roller 33K when the supply bias and the biases of two phases applied to the flare roller 33K are grounded in order to examine frictional charge properties of both the flare roller 33K and the supply roller 34K by removing the effects of the bias applied to the supply roller 34K and the bias applied to the flare roller 33K from the effects of the electrical potential of the supply roller 34K and the surface potential of the flare roller 33K.

The result shows that the flare roller 33K is supplied with a voltage of about −40 V due to the frictional charge between the flare roller 33K and the supply roller 34K. A value of a convergence rate is affected by a relation of triboelectric series between the supply roller 34K and the surface protection layer of the flare roller 33K, an amount of depression in the supply roller 34K, and the like.

A third factor is an induction of an electrical charge canceling a negative charge of toner particles.

Figure 16:
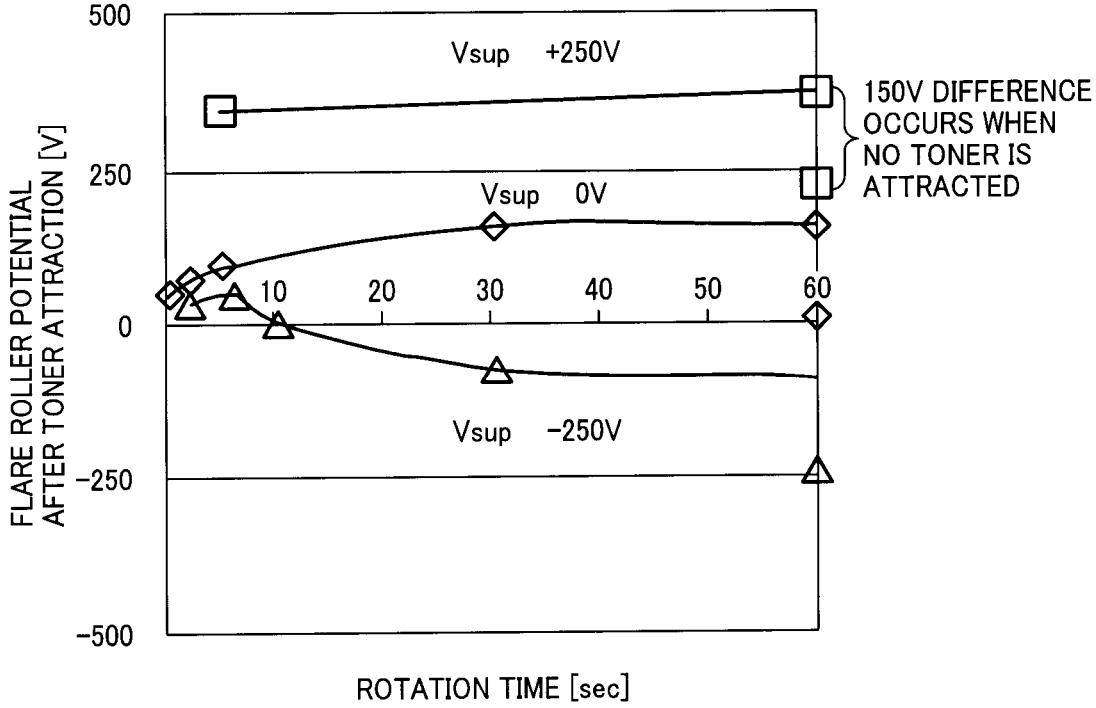
FIG. 16 is a graph illustrating a difference in the surface potential of the flare roller shown in FIG. 7 between when hopping toner particles are attracted to the flare roller and when no hopping toner particles are attracted thereto.

FIG. 16 is a graph illustrating a difference in the surface potential of the flare roller 33K between when the hopping toner particles are attracted to the flare roller 33K and when no hopping toner particles are attracted to the flare roller 33K.

When the toner particles supplied by the supply roller 34K hop on the flare roller 33K, a positive charge opposite to the negative charge of the toner particles is induced in the surface protection layer of the flare roller 33K. After the toner particles are removed from the flare roller 33K, the surface potential of the flare roller 33K is positively charged. The larger the amount of the negatively charged toner is, the larger the surface potential of the positively charged flare roller 33K becomes.

When the surface of the flare roller 33K is charged by the condenser only, that is, when only the first factor affects the surface potential of the flare roller 33K, the fluctuation of the surface potential of the flare roller 33K by the condenser model may be prevented, if the toner particles are supplied and collected by mechanical scraping without using an electrical field. However, since the second factor and the third factor also affect the surface potential of the flare roller 33K, in order to supply the surface of the flare roller 33K with a constant voltage to convey the toner particles to an area facing the photoconductor 50 (depicted in FIG. 1), the flare roller 33K needs to be discharged.

Figure 17:
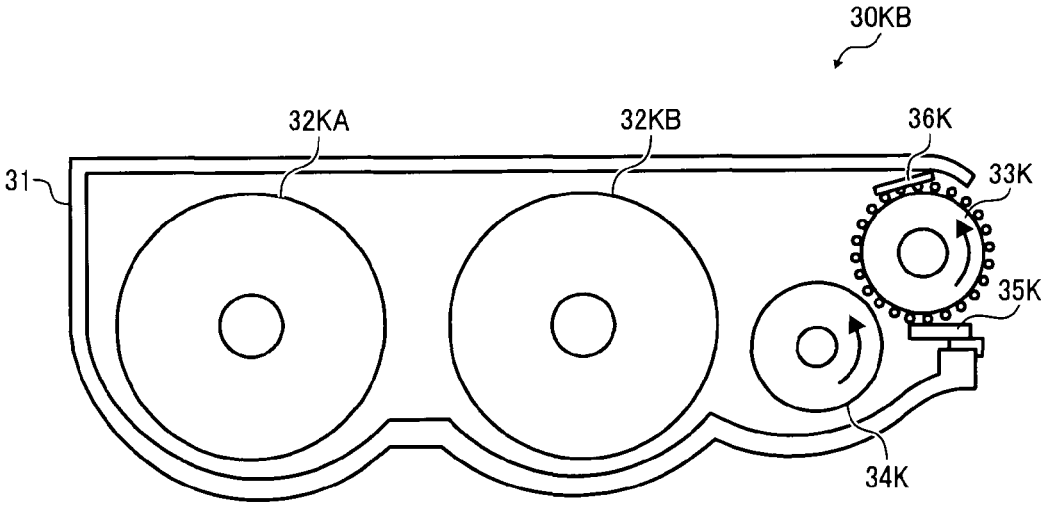
FIG. 17 is a sectional view of a development device as one modification example of the development device shown in FIG. 4.

FIG. 17 is a schematic view of a development device 30KB which is one modification example of the development device 30K (depicted in FIG. 4) according to this exemplary embodiment. The development device 30KB includes agitators 32KA and 32KB instead of the agitator 32K and does not include the collecting roller 37K and the flicker 38K. The other elements of the development device 30KB are common to the development device 30K.

The development device 30KB integrates the function of the collecting roller 37K into the supply roller 34K. The agitators 32KA and 32KB rotate in a direction opposite to each other, so that a developer (e.g., the toner) may move to circulate inside the casing 31K.

The development device 30 KB may achieve a surface potential control result similar to that of the above experiments using the development device 30K.

According to the above-described exemplary embodiments, the image forming apparatus 100 (depicted in FIG. 1) may include a process cartridge combining the development device 30K and the charger 56K (depicted in FIG. 1). The process cartridge may be detachably attachable to the image forming apparatus 100. Similarly, the development devices 30M, 30C, and 30Y, and the chargers 56M, 56C, and 56Y may be combined into respective process cartridges.

Figure 18:
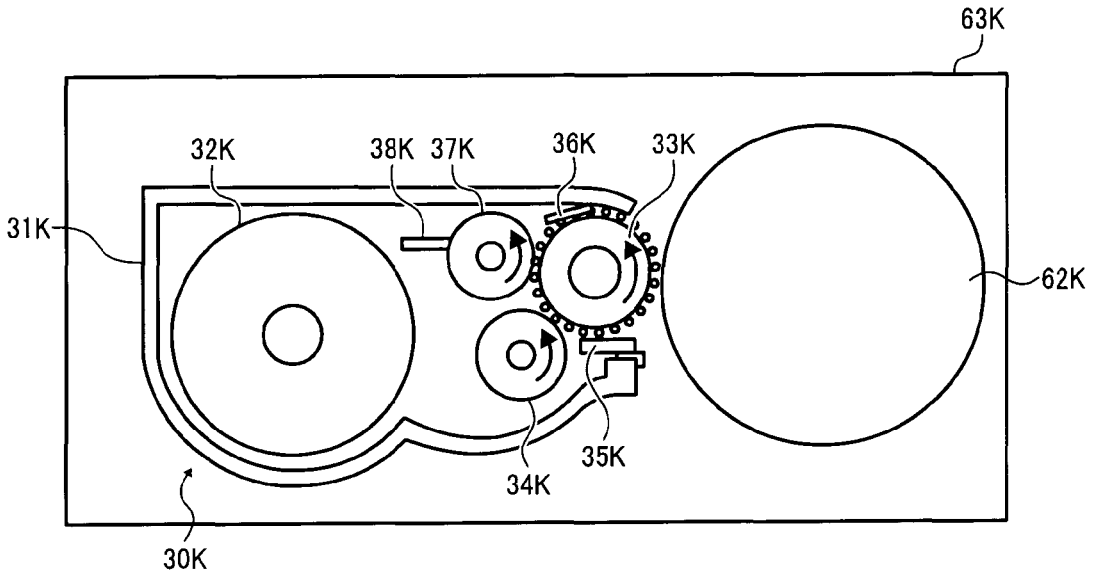
FIG. 18 is a sectional view of a process cartridge included in the image forming apparatus shown in FIG. 1.

Thus, FIG. 18 is a schematic view of a process cartridge 63K according to yet another exemplary embodiment. The process cartridge 63K includes the development device 30K and a photoconductor 62K.

The development device 30K and the photoconductor 62K, serving as a latent image carrier, are integrated into the process cartridge 63K. The process cartridge 63K, which forms a black toner image, may be detachably attachable to a tandem type image forming apparatus. In this case, the tandem type image forming apparatus may further include process cartridges for forming yellow, cyan, and magenta toner images, respectively. The development device 30K may have a structure identical to that of the development device 30KB (depicted in FIG. 17).

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A development device for developing a latent image formed on a latent image carrier, comprising:

a toner carrier configured to oppose the latent image carrier and carry toner particles to be adhered to the latent image formed on the latent image carrier;

a toner supplier configured to supply the toner particles to the toner carrier and having a time constant $\tau 1$ based on a resistive load of the toner supplier and a capacitance of the toner carrier; and a surface electrical potential controller configured to control a surface electrical potential of the toner carrier and having a time constant $\tau 2$ based on a resistive load of the surface electrical potential controller and the capacitance of the toner carrier, wherein the time constant $\tau 2$ is smaller than the time constant $\tau 1$, the toner carrier comprising:

a plurality of electrodes provided aligned in parallel on the surface of the toner carrier in a predetermined direction and electrically insulated from each other; and a voltage supplier configured to supply the plurality of electrodes with a voltage so as to periodically switch electrical fields between each electrode of the plurality of electrodes to cause the toner particles carried on the surface of the toner carrier to form a cloud while hopping on the surface of the toner carrier.

2. The development device according to claim 1, wherein the toner carrier and the surface electrical potential controller have an electrical potential of a polarity identical to a polarity of the toner particles, the toner carrier having a larger electrical potential absolute value than that of the surface electrical potential controller.

3. The development device according to claim 1, wherein a bias applied to the surface electrical potential controller has an electrical potential substantially equal to an average electrical potential of a voltage periodically applied to the plurality of electrodes of the toner carrier.

4. The development device according to claim 1, wherein the surface electrical potential controller is provided downstream from a development area in which the toner carrier develops the latent image and upstream from a supply area in which the toner supplier supplies the toner particles to the toner carrier in a direction of rotation of the toner carrier.

5. The development device according to claim 1, wherein the surface electrical potential controller functions as a toner collector for collecting the toner particles remaining on the toner carrier after development.

6. The development device according to claim 1, wherein the toner supplier comprises a rotatable sponge roller opposing the toner carrier.

7. The development device according to claim 1, wherein the toner supplier comprises a rotatable fur brush roller opposing the toner carrier.

8. An image forming apparatus, comprising:

a latent image carrier configured to carry a latent image; and a development device configured to develop the latent image carried by the latent image carrier, the development device comprising:

a toner carrier configured to oppose the latent image carrier and carry toner particles to be adhered to the latent image formed on the latent image carrier;

a toner supplier configured to supply the toner particles to the toner carrier and having a time constant $\tau 1$ based on a resistive load of the toner supplier and a capacitance of the toner carrier; and a surface electrical potential controller configured to control a surface electrical potential of the toner carrier and having a time constant $\tau 2$ based on a resistive load of the surface electrical potential controller and the capacitance of the toner carrier, wherein the time constant $\tau 2$ is smaller than the time constant $\tau 1$, the toner carrier, comprising:

a plurality of electrodes provided aligned in parallel on the surface of the toner carrier in a predetermined direction and electrically insulated from each other; and a voltage supplier configured to supply the plurality of electrodes with a voltage so as to periodically switch electrical fields between each electrode of the plurality of electrodes to cause the toner particles carried on the surface of the toner carrier to form a cloud while hopping on the surface of the toner carrier.

9. The image forming apparatus according to claim 8, further comprising:

at least one development device configured to develop the latent image formed on the latent image carrier using toner particles of different colors to form toner images of different colors and superimpose the toner images of different colors on the latent image carrier.

* * * * *